United States Patent [19]

Webb

[11] Patent Number: 5,072,704

[45] Date of Patent: Dec. 17, 1991

[54] PERSONAL WATERCRAFT VEHICLE ENGINE

[75] Inventor: Edward H. Webb, Paynesville, Minn.

[73] Assignee: Koronis Parts, Inc., Paynesville, Minn.

[21] Appl. No.: 579,107

[22] Filed: Sep. 6, 1990

Related U.S. Application Data

[63] Continuation of Ser. No. 364,794, Jun. 9, 1989, abandoned.

[51] Int. Cl.[5] ..... F02N 15/06

[52] U.S. Cl. ..... 123/179.1; 123/195 E; 123/179.25; 74/6

[58] Field of Search ..... 123/179 R, 179 M, 179 SE, 123/195 P, 195 E; 74/6

[56] References Cited

U.S. PATENT DOCUMENTS

| | | | |
|---|---|---|---|
| 990,730 | 4/1911 | Hallock et al. | 74/6 |
| 1,102,338 | 7/1914 | Jenkins | 74/6 |
| 1,693,342 | 11/1928 | McGrath | 123/179 M |
| 3,332,410 | 7/1967 | Dwyer, Jr. | 123/179 SE |
| 3,536,051 | 10/1970 | Hamman | 123/179 SE |
| 3,952,718 | 4/1976 | Meyer | 123/179 SE |
| 4,064,823 | 12/1977 | Draxler | 123/179 SE |
| 4,362,065 | 12/1982 | Baratti | 123/179 M |
| 4,457,726 | 7/1984 | Jacobson | 123/179 SE |
| 4,931,680 | 6/1990 | Sugiyama | 123/179 M |

*Primary Examiner*—Andrew M. Dolinar

*Attorney, Agent, or Firm*—Merchant, Gould, Smith, Edell, Welter & Schmidt

[57] ABSTRACT

An engine (10) includes a starter (28) mounted to the top portion (11*a*) of a crankcase (11). Further, engine (10) utilizes a flywheel (23) which has its teeth (23*c*) as an integral one-piece unit.

10 Claims, 2 Drawing Sheets

PERSONAL WATERCRAFT VEHICLE ENGINE

This is a continuation of application Ser. No. 07/364,794, filed June 9, 1989, which was abandoned upon the filing hereof.

BACKGROUND OF THE INVENTION

1. Field of the Invention

This invention relates generally to a personal watercraft vehicle engine and more particularly to an engine having a starter cooperatively connected to the upper portion of the crankcase and also an engine having an integral, one-piece flywheel.

2. Description of the Prior Art

Engines which are utilized in the personal watercraft industry are all somewhat similar to a snowmobile engine, in that the starter is mounted parallel with the crankshaft and is mounted very low on the engine assembly. When using a personal watercraft vehicle, water will sometimes enter the hull during extreme or even normal use. One of the items that is adversely effected by the entry of water is the starter. If the starter gets wet, when the operator attempts to start the vehicle, the starter does not engage, causing the operator to be stalled out on the lake and having to be towed back to shore. This creates not only an inconvenience but also a potential safety problem. The present invention addresses the problems associated with the prior art devices and provides for a personal watercraft engine having its starter mounted on the top portion of the crankcase in addition provides an engine which utilizes a one piece integral flywheel which provides for a lighter flywheel.

SUMMARY OF THE INVENTION

A personal watercraft vehicle engine has a crankshaft having an upper portion and a lower portion. A crankshaft is operatively mounted in the crankcase and a flywheel is cooperatively connected to one end of the crankshaft. The flywheel has a plurality of gear teeth around its periphery. The starter is cooperatively connected to the upper portion of the crankcase, whereby the starter is not adversely effected by water. In a preferred embodiment, the starter is mounted generally perpendicular to the crankshaft and at the forward portion of the crankcase. The teeth of the flywheel, preferably, extend generally outward and parallel to the crankshaft and are formed as an integral, one-piece unit with the flywheel. The flywheel may be made by either machining from a single piece of metal or as pressed from powdered metal to form a single metal part.

DESCRIPTION OF THE PREFERRED EMBODIMENT

Figure 1:
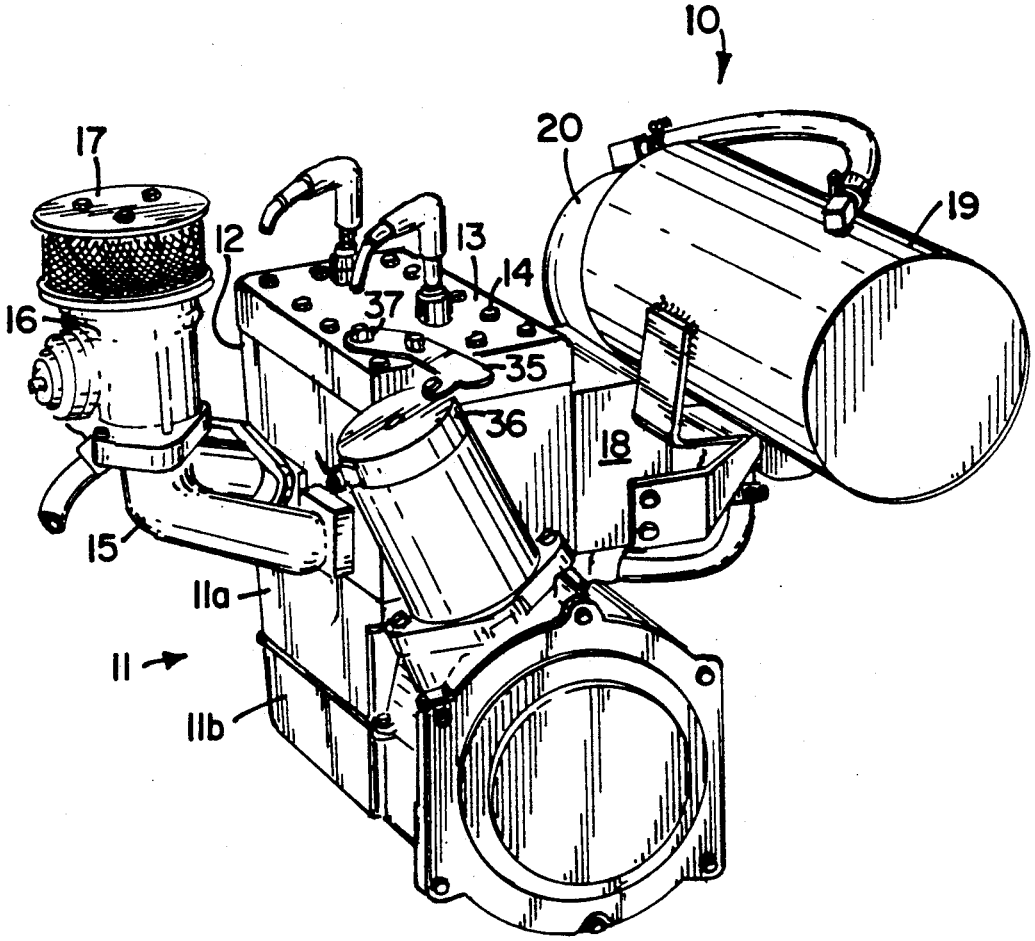
FIG. 1 is a perspective view of a personal watercraft engine incorporating the present invention.

Referring to the drawings, wherein like numerals represent like parts throughout the several views, there is generally disclosed at 10 a personal watercraft vehicle engine. The engine 10, with the exception of the mounting of the starter and the flywheel, may be any suitable personal watercraft vehicle engine, and this invention is not necessarily limited to use in only watercraft engines, although the unique design of this invention is of particular importance for watercraft vehicles. FIG. 1 generally shows an engine 10 which includes a crankcase 11 having a top portion 11*a* cooperatively connected to a bottom portion 11*b* by means well-known in the art. A cylinder block 12 is cooperatively mounted on the top portion 11*a* and a cylinder head 13 is mounted to the cylinder block 12 by a suitable means such as bolts 14. An intake manifold 15 is operatively connected to the cylinder block 12 and a carburetor 16 is operatively connected to the intake manifold 15. The flame arrester 17 is operatively connected to the carburetor 16. An exhaust manifold is operatively connected to the exhaust from the cylinder block 12. The expansion chamber 19 is operatively connected to the exhaust manifold 18 by means of the head pipe 20. The engine 10 also includes a crankshaft 21 operatively connected and positioned in the crankcase 11. The engine shown in the figure is a two cylinder engine, but it is understood that the present invention may be utilized with other configurations. Still further, the engine 10, described so far, is well-known in the art and specific details of construction are not given as they are well-known in the art.

Figure 2:
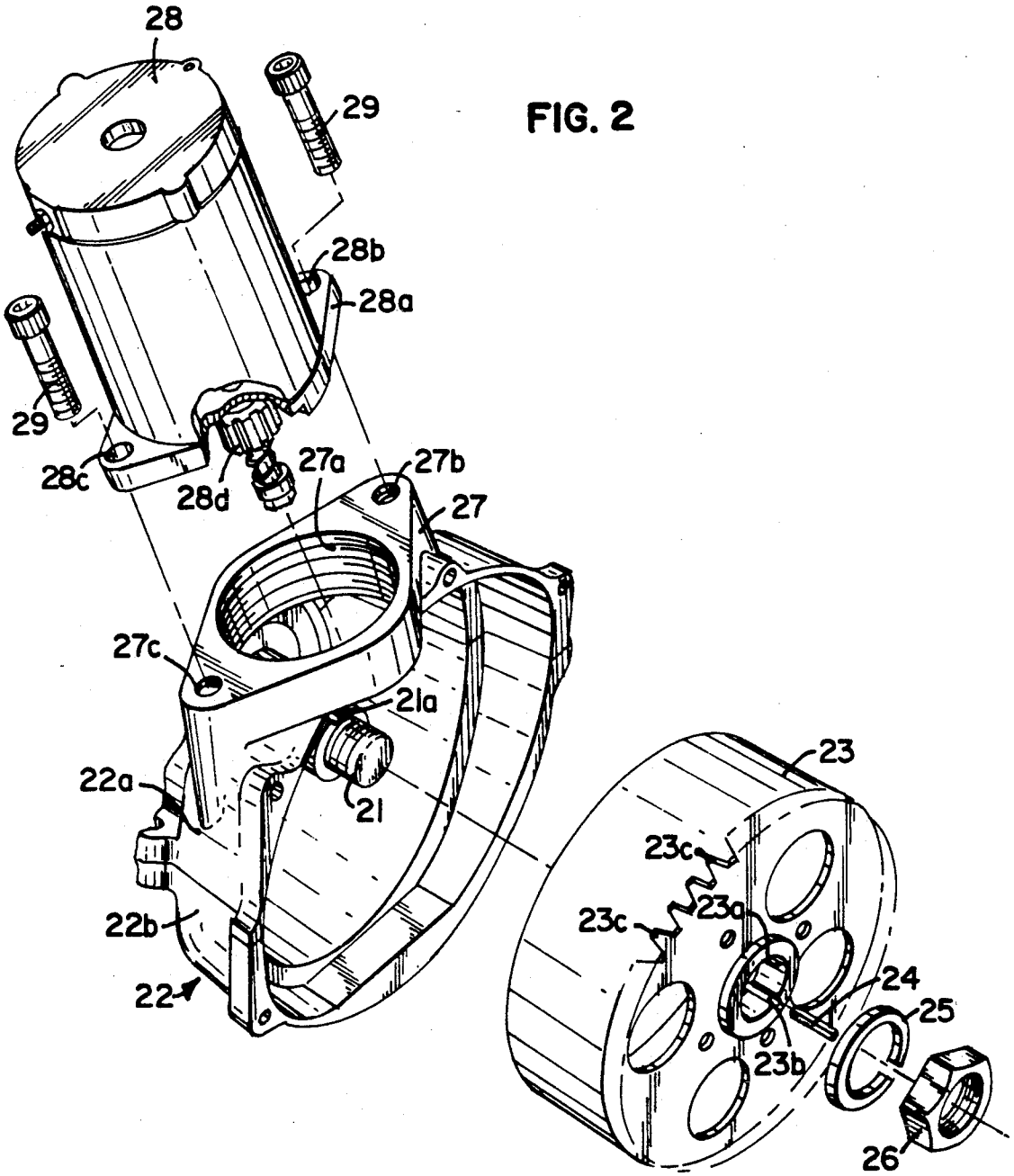
FIG. 2 is an exploded perspective view of a portion of the engine showing the mounting of the starter and the flywheel of the engine shown in FIG. 1.

Referring to FIG. 2, the present invention can be seen in detail. A flywheel housing, generally designated at 22, is cooperatively connected to the crankcase 11 by means well known in the art. The housing 22 includes a top portion 22*a* and a bottom portion 22*b* which, together, form the housing for the flywheel 23. The crankshaft 21 extends into the housing 22 and the crankshaft has a keyway 21*a*. The flywheel 23 has an aperture 23*a* and a keyway 23*b*. The flywheel is cooperatively connected to the crankshaft 21 by means of a key 24, lock washer 25 and flywheel nut 26.

As can be seen, the top portion of the flywheel housing is in alignment with the top portion of the crankcase and a bottom of the housing is in alignment with the bottom portion of the crankcase. Accordingly, when used in this application, and specifically the claims, the use of crankcase means both the top portion 11*a* and the top portion of the flywheel housing 22*a* which together form the overall top portion and the bottom portion 11*b* which, in conjunction with the bottom portion 22*b* of the flywheel housing, form the bottom portion.

The top portion 22*a* of the flywheel housing 22 has a starter mounting member 27 cooperatively connected thereto and preferably constructed as a one-piece unit with the top portion 22*a* of the flywheel housing 22. The starter mounting member has a central opening 27*a* and two threaded holes 27*b* and 27*c*.

The starter 28 has a base plate 28*a* having holes 28*b* and 28*c*. The base plate 28*a* is sized and configured to mate with the top surface of the starter mounting member 27. The starter 28 may be any suitable starter, such starters being well known in the art. The starter 28 has a pinion gear 28*d* cooperatively connected thereto by means well known in the art for engaging the flywheel 23. The starter 28 is mounted to the top portion of the flywheel housing 22*a* through the starter mounting member 27 by means of bolts 29.

The flywheel 23 has a plurality of teeth 23*c* which extend around the periphery of the flywheel 23. While only five teeth are actually shown in the drawing, it is understood that they extend 360° around the periphery of the flywheel 23. Further, the flywheel and teeth are formed as an integral one-piece unit. The flywheel and teeth may be machined from a single piece of metal or, more economically, pressed from a powdered metal to form a single metal part. The teeth 23*c* extend outward, in a direction generally parallel to the longitudinal axis of the crankshaft 21. The prior art flywheels typically have the teeth, as a separate assembly, pressed around the outer surface of the flywheel. However, by making the flywheel and teeth as an integral, one-piece unit, the flywheel assembly is able to be made lighter than the typical prior art flywheel.

The starter in the present invention is mounted generally perpendicular to the crankshaft and is mounted on the top half of the crankcase 11. When the starter 28 is activated, the gear teeth 28*d* go down and engage the teeth 23*c* of the flywheel. The results in the significant advantage that the starter 28 is moved out of an area which is most likely to have moisture in a personal watercraft vehicle. Another significant advantage is that the prior art starters are typically located in an area which is very difficult to access. It takes a considerable amount of time to disassemble different parts from the engine to get a prior art starter removed and subsequently repaired. The present invention provides for a substantially upright starter 28 which is positioned at the front portion of the engine 10 and is easily accessible. Further, it is only necessary to remove two bolts to disengage the starter from the crankcase, although the starter bracket 35 may also have to be removed. The bracket 35 is secured to head 13 by bolts 37 and to the starter 28 by screw 36.

In use in a watercraft vehicle, the engine 10 is generally mounted in the craft in an orientation as show in FIG. 1. Therefore the starter 28 is in the forward portion of the engine and is also connected to the top portion of the crankcase. The starter is also perpendicular to the crankcase. By reorienting the teeth 90°, as opposed to most of the prior art flywheels, the starter can be mounted perpendicular to the crankshaft.

The starter 28, as shown in the drawings, is mounted at a 20° angle to the vertical. This places the starter 28 closer to the actual top of the crankcase. While Applicant has found that placing a starter anywhere on the top portion of the crankcase is advantageous, it is preferred that the starter 28 be mounted within 45° of the vertical and preferably within 20° of the vertical.

Other modifications of the invention will be apparent to those skilled in the art in light of the foregoing description. This description is intended to provide specific examples of individual embodiments which clearly disclose the present invention. Accordingly, the invention is not limited to these embodiments of the use of elements having specific configurations and shapes as presented herein. All alternative modifications and variations of the present invention which follow in the spirit and broad scope of the appended claims are included.

I claim:

1. A personal watercraft vehicle engine comprising:

(a) a crankcase having an upper portion and a lower portion (b) a crankshaft operatively mounted in said crankcase, the crankshaft residing in a substantially horizontal orientation, the crankshaft having a longitudinal axis;

(c) a sealed flywheel housing, the sealed flywheel housing being axially aligned with the crankshaft;

(d) a flywheel cooperatively connected to said crankshaft, the flywheel residing in the flywheel housing, the flywheel housing being rigidly affixed to the crankcase;

(e) said flywheel having a plurality of gear teeth around its periphery; and (f) a starter mounted in an opening defined in a plane parallel to the crankshaft and perpendicular to the starter axis, the starter being perpendicular to the crankshaft, in an uppermost portion of the sealed flywheel housing, the starter having a pinion gear, the pinion gear being engagable with the plurality of gear teeth on the periphery of the flywheel, whereby said starter is not as adversely affected by water.

2. The engine of claim 1, wherein said teeth extend outward, generally parallel to the longitudinal axis of said crankshaft.

3. The engine of claim 1, wherein said starter is mounted generally perpendicular to said crankshaft, the starter residing with 20° of a vertical orientation.

4. The engine of claim 1, wherein said crankshaft extends into the flywheel housing, the flywheel being affixed to the crankshaft within the flywheel housing, the starter pinion gear thereby tending to impart rotational movement directly to the crankshaft via the flywheel.

5. The engine of claim 1, wherein said flywheel and teeth are formed as an integral, one-piece unit.

6. The engine of claim 5, wherein said flywheel and teeth are machined from a single piece of metal.

7. The engine of claim 5, wherein said flywheel and teeth are pressed from a powdered metal to form a single pressed metal part.

8. A personal watercraft vehicle engine comprising:

(a) a crankcase having an upper portion and a lower portion;

(b) a substantially horizontal crankshaft operatively mounted in said crankcase;

(c) a flywheel cooperatively connected to said crankshaft, said flywheel residing in a substantially vertical plane;

(d) said flywheel having a plurality of gear teeth extending outward, generally perpendicular to said crankshaft, said flywheel and teeth being formed as a single one-piece unit; and (e) a starter cooperatively connected to said upper and forward portions of said crankcase, and generally perpendicular to said crankshaft, the starter being oriented at a 20° angle with reference to a vertical axis, whereby said starter is not as adversely affected by water.

9. The engine of claim 8, wherein said flywheel and teeth are machined from a single piece of metal.

10. The engine of claim 8, wherein said flywheel and teeth are a single pressed metal part.

* * * * *